US006895622B2

(12) United States Patent
Szekely

(10) Patent No.: US 6,895,622 B2
(45) Date of Patent: May 24, 2005

(54) TRANSIT BOARDING PLATFORM PANEL

(75) Inventor: Kenneth E. J. Szekely, Oakville (CA)

(73) Assignee: Astra Capital Incorporated, Oakville (CA)

( * ) Notice: Subject to any disclaimer, the term of this patent is extended or adjusted under 35 U.S.C. 154(b) by 0 days.

(21) Appl. No.: 10/244,958

(22) Filed: Sep. 16, 2002

(65) Prior Publication Data

US 2003/0084523 A1 May 8, 2003

Related U.S. Application Data

(63) Continuation-in-part of application No. 09/609,971, filed on Jul. 3, 2000, now Pat. No. 6,449,790.

(51) Int. Cl.[7] ..... E01D 19/12
(52) U.S. Cl. ..... 14/69.5; 14/73
(58) Field of Search ..... 14/68.5, 73

(56) References Cited

U.S. PATENT DOCUMENTS

| | | | | |
|---|---|---|---|---|
| 3,196,763 A | | 7/1965 | Rushton | |
| 3,943,589 A | | 3/1976 | Pedersen | |
| 4,443,905 A | | 4/1984 | Kopp | |
| 4,453,283 A | | 6/1984 | Fitzgerald-Smith et al. | |
| 5,006,011 A | | 4/1991 | Hiyashi | |
| 5,010,614 A | | 4/1991 | Braemert et al. | |
| 5,081,946 A | | 1/1992 | Nannig et al. | |
| 5,287,649 A | | 2/1994 | Presetele | |
| 5,303,669 A | | 4/1994 | Szekely | |
| 5,328,293 A | | 7/1994 | Keefe | |
| 5,444,885 A | | 8/1995 | Hanrahan et al. | |
| 5,499,888 A | | 3/1996 | Hawkes | |
| 5,587,218 A | * | 12/1996 | Betz | 428/67 |
| 5,603,134 A | | 2/1997 | Whipkey et al. | |
| 5,775,835 A | | 7/1998 | Szekely | |
| 5,794,402 A | | 8/1998 | Dumlao et al. | |
| 5,807,021 A | | 9/1998 | Aaron | |
| 5,901,396 A | | 5/1999 | Ahlskog et al. | |
| 5,903,943 A | | 5/1999 | Sherrod | |
| 5,924,152 A | | 7/1999 | Maier | |
| 6,119,634 A | | 9/2000 | Myrick | |
| 6,269,508 B1 | | 8/2001 | Younce | |
| 6,309,732 B1 | * | 10/2001 | Lopez-Anido et al. | 428/178 |
| 6,591,567 B2 | * | 7/2003 | Hota et al. | 52/578 |

* cited by examiner

*Primary Examiner*—Gary S. Hartmann
(74) *Attorney, Agent, or Firm*—Volpe and Koenig, P.C.

(57) ABSTRACT

A transit boarding platform panel comprising a base portion formed from a reinforced composite polymer. The base portion has a top deck and a bottom plate, a first end, a second end, a first side and second side. Between the top deck and bottom plate are a series of internal longitudinal and cross support members. The top deck has a central section and opposite end sections. Detectable warning tiles are mounted to the top surfaces of the end sections. The top surface of the central section has a slip resistant surface. Positive drainage is provided by the top deck to facilitate runoff of any precipitation and prevent standing pools of water. Positive drainage is further provided by the interface between adjacent panels utilizing a ship lap configuration with a drainage channel beneath the joint between adjacent panels.

8 Claims, 7 Drawing Sheets

TRANSIT BOARDING PLATFORM PANEL

CROSS-REFERENCE TO RELATED APPLICATION:

This application is a continuation in part of U.S. patent application Ser. No. 09/609,971 filed Jul. 3, 2000, now U.S. Pat. No. 6,449,790, which is hereby incorporated by reference.

BACKGROUND OF THE INVENTION

This invention relates to a system for use as transit boarding platform structures. In particular the present invention provides panels to replace pre-cast concrete panels or cast-in-place concrete panels typically used for transit boarding platforms. In a preferred embodiment, the panels of the present invention are formed of reinforced polymer composite materials and incorporate a non-slip walking surface for improved wear and slip resistance.

Conventional concrete and wooden transit platforms have a durability problem due to degradation by environmental chemicals such as, salt, urea, acid rain, oils and greases as well as stray electrical currents. This necessitates regular maintenance and periodic replacement of the platforms at considerable cost to transit authorities. Replacement is further complicated with trains going by the platform every few minutes. Steel and concrete are also susceptible to corrosive elements, such as water, salt water and agents present in the environment such as acid rain, road salts, chemicals, oxygen and the like. Environmental exposure of concrete structures leads to pitting and spalling in concrete and thereby results in severe cracking and a significant decrease in strength in the concrete structure. Steel is likewise susceptible to corrosion, such as rust, by chemical attack. The rusting of steel weakens the steel, transferring tensile load to the concrete, thereby cracking the structure. The rusting of steel in stand alone applications requires ongoing maintenance, and after a period of time corrosion can result in failure of the structure. The planned life of steel structures is likewise reduced by rust. Wood, like concrete and steel, is also susceptible to environmental attack, especially rot from weather and termites. In such environments, wood encounters a drastic reduction in strength which compromises the integrity of the structure. Moreover, wood undergoes accelerated deterioration in structures in marine environments.

Concrete transit platforms are typically constructed with the concrete poured in situ as well as using some preformed components pre-cast into structural components such as supports and transported to the site of the construction. Constructing such concrete structures in situ requires hauling building materials and heavy equipment and pouring and casting the components on site. This process of construction involves a long construction time and is generally costly, time consuming, subject to delay due to weather and environmental conditions and the requirement not to disrupt the schedule of trains unduly.

On the other hand, pre-cast concrete structural components are extremely heavy and bulky. Therefore, they are also typically costly and difficult to transport to the site of construction due in part to their bulkiness and heavy weight. Although construction time is shortened as compared to poured in situ, extensive time, with resulting delays, is still a factor. Construction with such pre-cast forms is particularly difficult, if not impossible, in areas with difficult access or where the working area is severely restricted due to adjoining tracks, buildings or platforms. There is a need for a light weight structure to facilitate installation in areas which have difficult access and working area. In addition a lightweight structure could eliminate the costly concrete foundations and steel support systems necessary to support conventional concrete platforms.

There have been solutions proposed for preventing deterioration of steel and concrete bridge and roadway decks. For example U.S. Pat. No. 5,901,396 discloses the use of an aluminum bridge deck to provide light weight and durability. In addressing the limitations of existing concrete, wood and steel structures, some fiber reinforced polymer composite materials have been explored for use in constructing parts of bridges including foot traffic bridges, piers, and decks and hulls of some small vessels. Fiber reinforced polymers have been investigated for incorporation into foot bridges and some other structural uses such as houses, catwalks, and skyscraper towers. These composite materials have been utilized in conjunction with, and as an alternative to, steel, wood or concrete due to their high strength, light weight and highly corrosion resistant properties. However, construction of load bearing applications built with polymer matrix composite materials have not been widely implemented due to extremely high costs of materials, high assembly costs and uncertain performance, including doubts about long term durability and maintenance. As cost is significant in the public transit industry, such materials have not been considered feasible alternatives for many load bearing traffic designs. For example, high performance composites made with relatively expensive carbon fibers have frequently been eliminated by cost considerations.

U.S. Pat. No. 5,794,402 is directed to a polymer matrix composite modular load bearing deck as a part of a modular structural section for a highway bridge deck. The load bearing deck is formed from a plurality of sandwich panels, each panel having a flat upper surface, a lower surface and a core. The core includes a plurality of trapezoidal, substantially hollow, elongated core members positioned between the upper surface and the lower surface. Each core member has side walls positioned generally adjacent to a side wall of an adjacent core member and are joined together by fasteners, such as bolts and screws, or by adhesives. The assembly time required to fasten the deck together renders the cost prohibitive and impractical for use in a transit platform.

In public transit facilities, such as subway stations and railway stations, there is also a requirement for pedestrians to be able to safely navigate the platform. There is a need for pedestrians to get good traction on the platform to prevent slips and falls in particular on outdoor platforms that can be subject to wind, rain and snow conditions. In addition it is important for pedestrians to be able to detect the location of platform edges so that the pedestrian does not accidentally walk off the edge of the platform. The need for making platform edges detectable is of course particularly acute in attempting to make such facilities accessible and safe for blind or visually impaired persons.

In the 1980's a series of studies were undertaken in the United States to improve the design of buildings and transportation facilities to improve the mobility of the visually impaired. These studies culminated in recommendations on making potential hazards detectable to the visually impaired either by use of the long cane or underfoot.

*Americans with Disabilities Act* (ADA): *Accessibility Guidelines for Buildings* and *Facilities* set the requirements for the use of detectable warnings on inter alia transit platforms to warn visually impaired persons of hazards. The Guidelines require that detectable warnings shall consist of raised truncated domes of prescribed diameter, height and center-to-center spacing and shall contrast visually with adjoining surfaces. Detectable warnings used on interior surfaces are required to differ from adjoining surfaces in resiliency or sound-on-cane contact. Various tactile tiles having raised truncated domes in compliance with the ADA Guidelines or the equivalent have been developed such as those shown in U.S. Pat. No. 4,715,743 and U.S. Pat. No. 5,303,669. Other tactile surfaces have been proposed such as the rubber on concrete composite tile illustrated in Netherlands Patent 8600855.

U.S. Pat. No. 5,303,669 describes a detectable tactile tile that is intended to be installed in concrete or the like. The tiles are illustrated as square with depending flanges projecting downward from the edge of the tile. The flanges have holes through them to assist in anchoring the tile in freshly poured concrete. The holes in the flanges around the perimeter of the tiles permit air to flow out from under the tiles when they are pressed into the concrete. However it is virtually impossible to remove all of the air and there is typically an air space between the bottom surface of the tile and the top of the cured concrete. When baggage carts, money carts with small wheels or heavy mechanical equipment either for cleaning, snow removal etc. passes over the tiles, there may be a tendency for the tiles to crack under the weight of the equipment, due to the air space between tiles and the concrete surface.

U.S. Pat. No. 5,775,835 provides a tactile tile for embedment in fresh concrete on a platform or walking surface. By anchoring the tiles with the concrete through holes in depending flanges the need for adhesives or mechanical fasteners which are labor intensive to install are eliminated or reduced. The bottom surface of the tile is provided with a series of projections. As the tile is being pushed into the concrete the projections assist in having the concrete flow underneath the tile and as the concrete cures and shrinks slightly the projections remain in contact with the cured surface of the concrete so that the tile is fully supported across its surface. During snow removal or cleaning, the tile will then support the weight of any heavy mechanical equipment and eliminate cracking of the tiles and their necessary replacement. As the fresh concrete cures, an air space forms between the bottom surface and the surface of the cured concrete. This air space prevents the load from equipment moved over the tiles from being transferred to the platform surface resulting in potential damage to the tiles. By incorporating the projections into the bottom surface the loads can be transferred to the platform or walkway surface through the conical standoffs. However the airspace between the concrete surface and the bottom surface is not eliminated resulting in a hollow sound when struck by the cane of a visually impaired person. This distinct sound-on-cane contact between the tiles and the adjoining concrete surface permits the tiles to be used indoors in compliance with the ADA Guidelines. Where the tiles are bonded by an adhesive or mechanically fastened directly to the concrete surface it may not be possible to get a distinctive sound-on-cane contact with a hard material of manufacture such as ceramic, glass reinforced thermosetting resin or vitrified polymer composite and softer resilient rubber or vinyl tiles must be used. In addition use of the projections increases the surface area of the tile that is in contact with the cured concrete which helps resist movement due to thermal expansion etc.

In conventional systems there is also a problem with drainage. Corrosive elements can penetrate past poorly installed or worn sealant joints leading to the deterioration of the steel support structure and concrete foundation.

SUMMARY OF THE INVENTION

It is an object of the invention to provide a transit boarding platform structures to replace pre-cast concrete panels or cast-in-place concrete panels typically used for transit boarding platforms.

It is a further object of the invention to provide transit platform panel formed of reinforced polymer composite materials and incorporating a detectable warning surface in accordance with *Americans with Disabilities Act* (ADA): *Accessibility Guidelines for Buildings* and *Facilities.*

Thus in accordance with the present invention there is provided a transit platform panel comprising a base portion formed from a reinforced composite polymer. The base portion has a top deck and a bottom plate, a first end, a second end, a first side and second side. One or both of the first and second ends is adjacent the edge of the platform. Between the top deck and bottom plate are a series of internal support members. Where the panel comprises the width of the platform the support members are both longitudinal and cross members. In other applications only cross support members are required. The top deck is adapted to have a detectable surface along the first and/or second ends that are adjacent the edge of the platform. Where the panel is the width of the platform, the top deck has a central section and opposite end sections. Detectable warning tiles are mounted to the top surfaces of the end sections. In this application the top surface of the central section has a slip resistant surface. In the preferred embodiment the slip resistant surface consists of a non-slip walking surface coating applied to the top deck. The slip resistant coating should be resistant to the effects of ultraviolet radiation, temperature changes and corrosive elements such as acids, alkalis, salts, phosphates, organic chemicals and solvents such as mineral spirits, gasoline etc. It should also preferably be sufficiently hard to protect against abrasion, chipping, scratching or marring.

Positive drainage, where required, may provided by the top deck being symmetrical about the mid-point line tapering from the mid-point to the ends of the panel to facilitate runoff of any precipitation and prevent standing pools of water. Positive drainage can further be provided by the interface between adjacent panels utilizing a ship lap configuration with a drainage channel beneath the joint between adjacent panels.

Further features of the invention will be described or will become apparent in the course of the following detailed description.

BRIEF DESCRIPTION OF THE DRAWINGS

In order that the invention may be more clearly understood, the preferred embodiments will now be described in detail by way of example, with reference to the accompanying drawings, in which.

DETAILED DESCRIPTION OF THE PREFERRED EMBODIMENT

Figure 1:
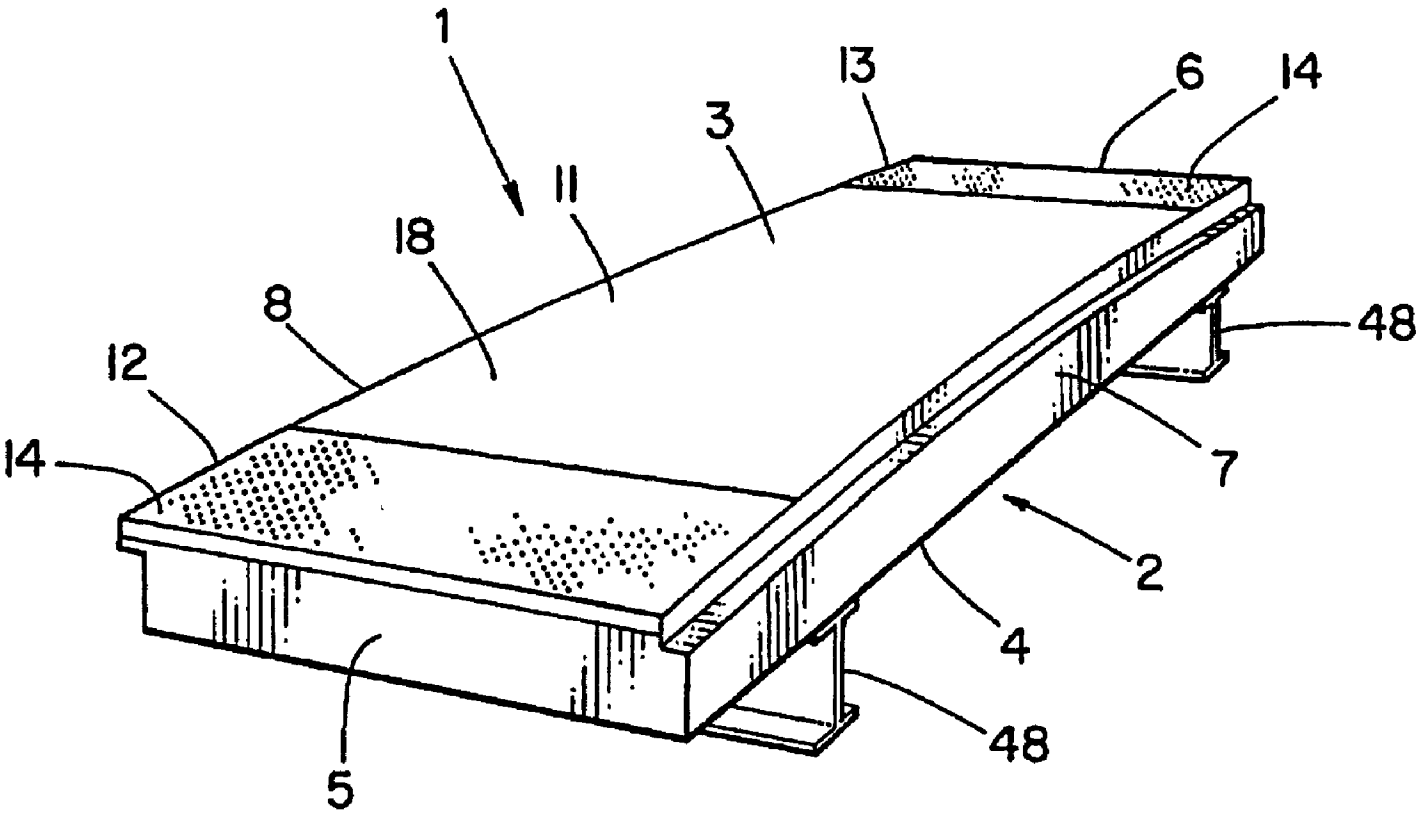
FIG. 1 is a perspective view of one embodiment of a transit boarding platform panel according to the present invention.

Referring to FIGS. 1 to 4 a preferred embodiment of transit boarding platform panel according to the present invention is generally indicated at 1. In the preferred embodiment illustrated the panel 1 comprises a base portion 2 formed from a reinforced composite polymer. The base portion 2 has top deck 3 and bottom plate 4, a first end 5, a second end 6, a first side 7 and second side 8. Between the top deck 3 and bottom plate 4 are a series of internal longitudinal and cross support members 9 and 10 respectively.

The top deck 3 has a central section 11 and end sections 12 and 13. Detectable warning tiles 14 are mounted to the top surfaces 15 and 16 of end sections 12 and 13. The top surface 17 of the central section 11 has a slip resistant coating 18 applied to it. In the preferred embodiment the slip resistant coating 18 consists of a non-slip monolithic walking surface. The slip resistant coating should be resistant to the effects of ultraviolet radiation, temperature changes and corrosive elements such as acids, alkalis, salts, phosphates, organic chemicals and solvents such as mineral spirits, gasoline etc. It should also preferably be sufficiently hard to protect against abrasion, chipping, scratching or marring. A suitable coating is the Diamond Tek™ coating system from Engineered Plastics Inc. of Buffalo, N.Y. The Diamond Tek™ coating can be sprayed on to the top deck 3 of the panel 1 and then fusion bonded. The coating 18 has a depth of about 0.1875 inches The detectable warning tiles 14 are similar to the tiles described in U.S. Pat. No. 5,303,669. The tiles, shown in FIGS. 1, 2, 5, 7 and 8, have a horizontal portion 50 adapted to overlie the top surfaces 15 and 16 of the end sections 12 and 13 of the top deck 3 of panel 1 up to the first and second ends 5 and 6, and rear and front edges 51 and 52 respectively, the "front" edge being the one remote from the ends 5 and 6 of panel 1.

Figure 2:
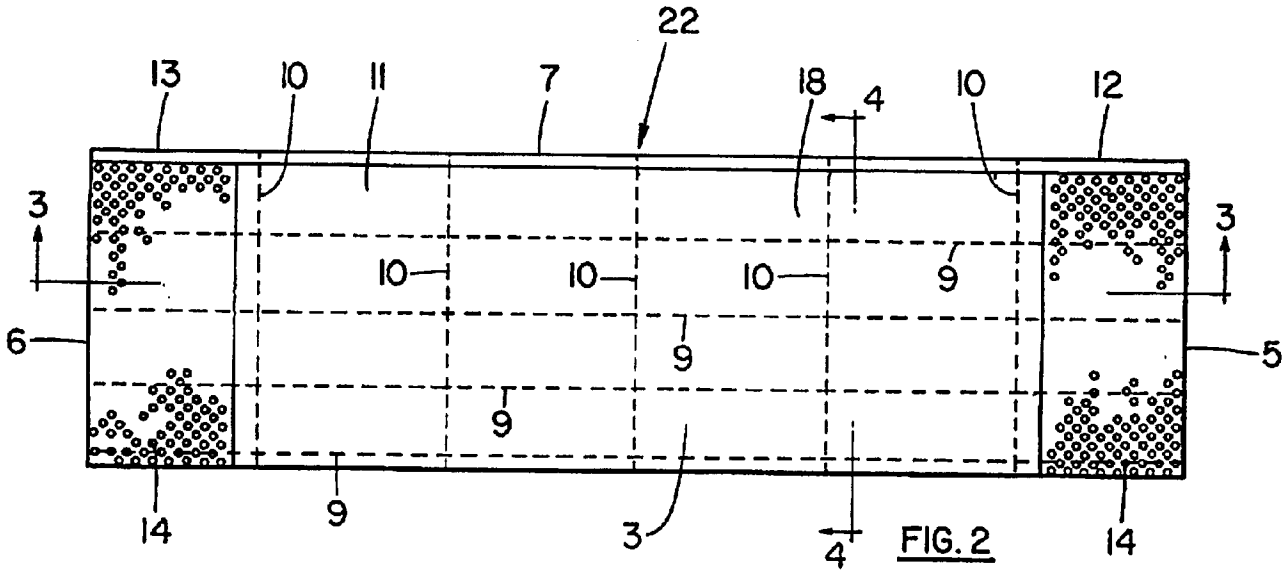
FIG. 2 is a top plan view of the transit boarding platform panel of FIG. 1 showing the position of the internal longitudinal and cross support members in dotted lines.
Figure 3:
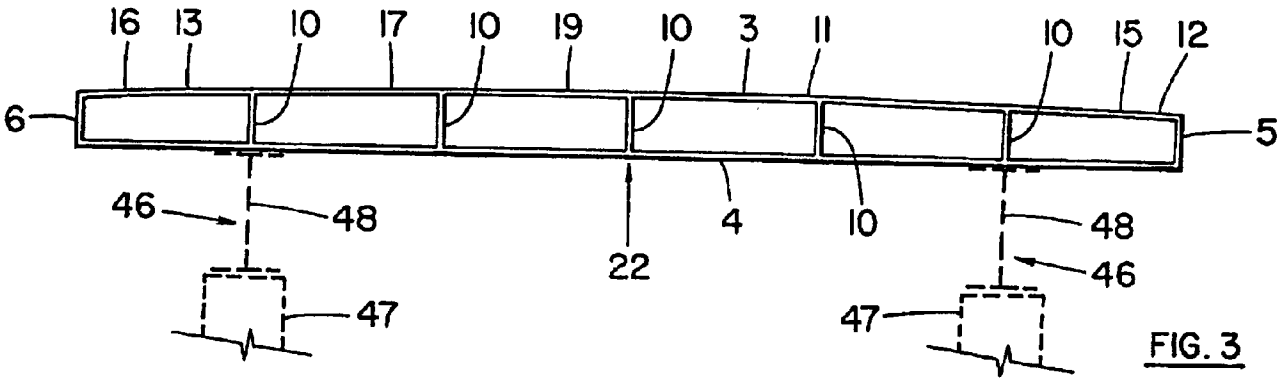
FIG. 3 is a schematic cross section of the transit boarding platform panel of FIG. 2 through line 3—3.

The surface of the horizontal portion 50 has plurality of rows of spaced buttons 53 projecting upwardly therefrom, thereby providing a distinctively textured surface relative to the texture of the surface of the platform. As can be seen in FIGS. 1 and 2, the buttons preferably are circular. Buttons in adjacent rows are offset from each other by one-half of the centerline spacing distance. The buttons 53 have generally flat upper surfaces which have texturing means thereon for creating a palpably rough surface texture. The texturing means in the preferred embodiment is provided by rows of semi-spherical raised dimples arranged in a grid pattern.

The areas between buttons preferably also have texturing means consisting of a plurality of rows of spaced dimples projecting upwardly therefrom, to provide slip resistance in those areas (e.g. for women in high heels and to improve maneuverability of wheelchairs).

Each tile preferably is the entire width of the panel to avoid the need for joints between tiles. The tiles preferably are bonded to the top surface of the end section by the use of a suitable adhesive, such as "Bostic Ultra-Set" (trademark) urethane adhesive. However, for added security, the tiles can also be mechanically fastened to the top deck.

To reduce the possibility of tripping, the height of the buttons in one or more rows adjacent the front edge 52 is reduced in height and diameter relative to the height and diameter of buttons in subsequent rows, so that there is a gradual increase in height and diameter. Thus in the preferred embodiment the buttons in the first row adjacent the front edge 52 are only about one-third as high as the other buttons and the buttons in the second row are only about two-thirds as high as the other buttons. Similarly the buttons in the first row have a diameter about 12% less than the other buttons and the buttons in the second row have a diameter about 3% less than the rest of the buttons.

Figure 5:
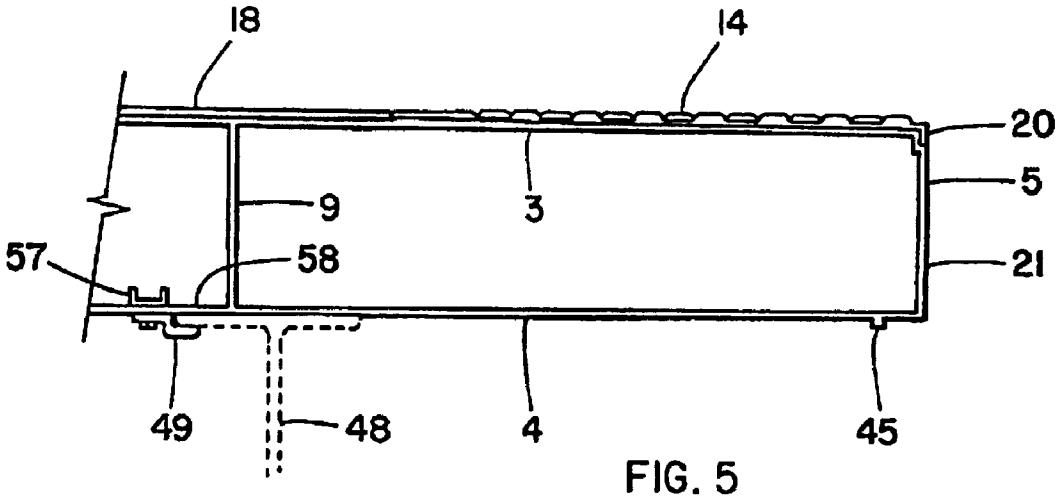
FIG. 5 is an enlarged view of one end of the transit boarding platform panel of FIGS. 2 and 3 showing the means of connection to an underlying support.
Figure 6:
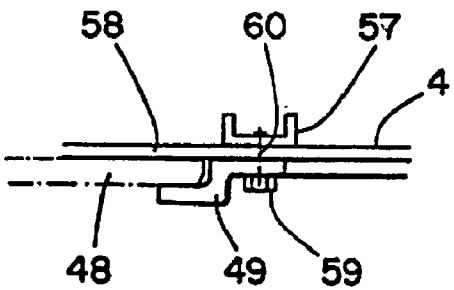
FIG. 6 is an enlarged view of the means of connection to an underlying support shown in FIG. 5.
Figure 7:
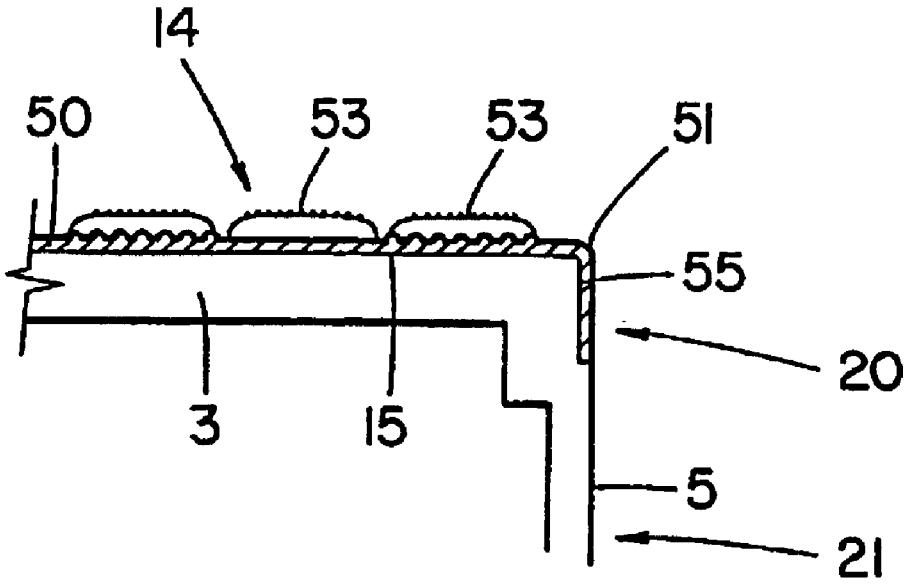
FIG. 7 is an enlarged view in cross section of a top corner of the transit boarding platform panel of FIG. 2.

The tiles 14 preferably have an integral depending flange 55, best seen in FIGS. 5 and 7, adapted to overlie the first and second ends 5 and 6 of the panel and thereby facilitate holding the tile in place. Preferably, an adhesive such as "Bostik Ultra-Set" (trademark) urethane adhesive is used to secure the flange 55 to the ends 5 and 6. The adhesive may be augmented by or replaced by mechanical fastening means. To facilitate a smooth mounting of the tiles the first and seconds 5 and 6 have their top portion 20 offset from the remaining height 21 of the ends 5, 6, the thickness of the depending flange 55 of the tiles 14. The top portion 20 is the length of the depending flange 55.

The tiles can be made of vinyl, rubber, urethane, ceramic or cast composite materials or the like. The edging tile is preferably made entirely of yellow thermoset glass-reinforced plastic composite material having the textured surface pattern as described. In addition, a micro-thin film may be applied to the upper surface if desired, to provide enhanced abrasion resistance characteristics. Because the entire tile preferably is brightly colored, it serves to visually alert sighted and visually impaired pedestrians of the vicinity of the subway platform edge. The textured surface provides a tactile signal as well, which is particularly important for the visually impaired. The buttons can be felt through most if not all footwear, and can also be readily detected by a "white cane" of the type frequently used by the blind or visually impaired. Certain types of conventional canes can detect the buttons very readily, while types may pass between the buttons and can readily detect the dimples in the areas between buttons. It is therefore preferable to have these dimples in the areas between buttons, and not just on the surface of the buttons themselves.

As an alternative to a single bright color, a scheme of alternating contrasting colors could be used to create a distinctive pattern, if desired.

It will be appreciated that a wide range of dimensions may be suitable for the edging tile and for the buttons. However, in the embodiment of the tile shown in the Figures, for example, key dimensions are as follows:

| | |
|---|---|
| Forward to rear dimension: | 24.00 inches |
| Tile width: | 47.75 inches |
| Tile thickness: | 0.100 inches |
| Button diameter (base): | 1.325 inches |
| Button diameter (top): | 0.875 inches |
| Button height (excluding dimples): | 0.200 inches |
| Button height (first row from front): | 0.066 inches |
| Button height (second row from front): | 0.132 inches |
| Spacing of buttons in the same row: (centerline to centerline): | 2.800 inches |
| Spacing of rows (centerline to centerline): | 1.400 inches |

It will be appreciated that the dimensions can be varied widely subject to the ADA Guidelines , as desired to suit the particular application.

Figure 8:
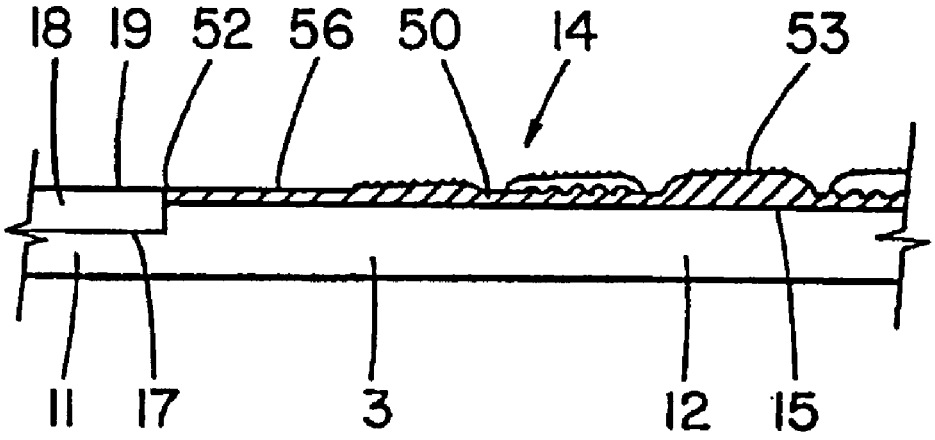
FIG. 8 is an enlarged view in cross section of part of the top surface of the transit boarding platform panel of FIG. 2 showing the interface between the detectable tactile surface and the granite wearing surface in the preferred embodiment.

As best shown in FIGS. 5 and 8, the top surface 17 of the central section 11 is recessed from the top surfaces 15, 16 of end sections 12 and 13 so that the top surface 56 of the tile 14 adjacent its front edge 51 will be flush with the top surface 19 of coating 18. As an alternative to applying the slip resistant coating in the preferred embodiment, the top surface 17 can be flush with the top surface 56 of tiles 14 and a slip resistant surface integrated into the top deck using a grid work of raised dimples etc. Alternatively the surface 17 of the central section 11 of the top deck can be finished with a vinyl, rubber, urethane, ceramic or cast composite materials or the like to provide the desired slip resistance. The minimum friction value established by the ADA guidelines is 0.6 for accessible routes. The preferred embodiment of the present invention exhibits both wet and dry coefficients of friction close to 1.00 exceeding the minimums required. In addition use of the Diamond Tek coating system resulted in abrasion values well above granite floor tiles.

The panel 1 of the preferred embodiment shown in the drawings has nominal dimensions of 15 feet long by about 4 feet in width. The base section 2 has a nominal thickness of between 8 inches at the first and second ends 5, 6 and 10 inches along the mid point line 22 of the panel. The top deck 3 is typically symmetrical about the mid-point line tapering from the mid-point to the ends 5, 6 to facilitate runoff of any precipitation and prevent standing pools of water. The weight of the preferred embodiment is about 480 lbs., about one-tenth the weight of standard precast concrete panels currently in use. The panels of the present invention were tested for vibration and load to test the ability of the panel to withstand the uplifting forces caused by passing rail traffic and the load bearing characteristics of the panel. Vibration tests on the preferred embodiment indicated vibration amplitudes below the human threshold of perception and comparable to results for precast concrete platforms.

Figure 4:
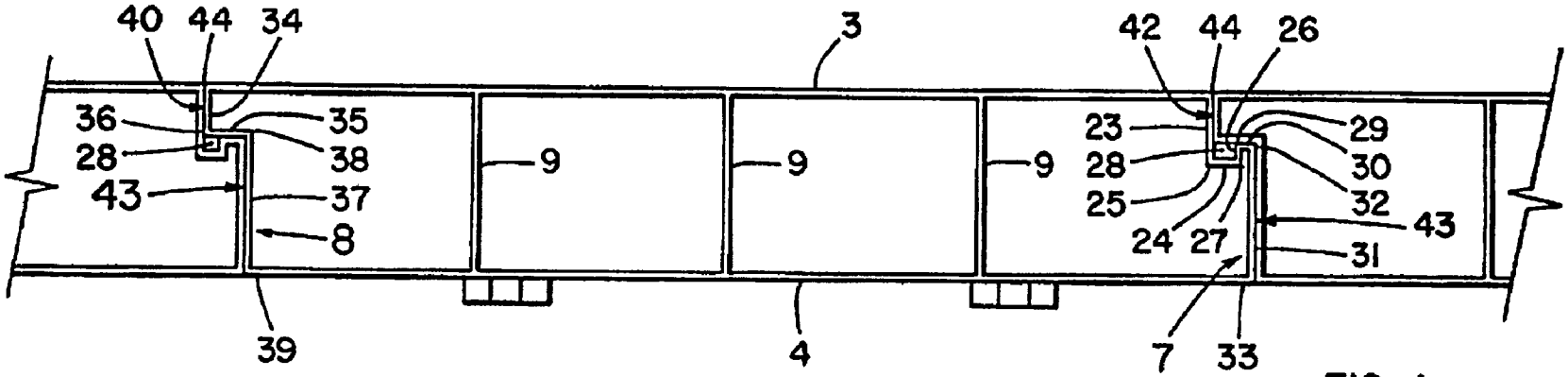
FIG. 4 is an enlarged cross section of the transit boarding platform panel of FIG. 2 along line 4—4 and showing adjacent panels.

With reference to FIG. 4, the interface between adjacent panels 1 utilizes a ship lap configuration. The first side 7 of base section 2 has a top section 42 having a first vertical wall section 23 extending from the top deck 3. A horizontal flange 24 extends outwardly from the base 25 of the vertical wall section 23. A second vertical wall section 26 extends upwards from the exterior edge 27 of flange 25. Extending outwardly from the top 29 of the second vertical wall section 26 is a second flange 30. This effectively creates a drainage channel 28 beneath the joint between adjacent panels. The bottom section 43 of side 7 has third vertical wall section 31 that depends from the outer edge 32 of the second flange 30 and connects to the edge 33 of bottom plate 4.

The other side 8 of the base section 2 has a top section 40 having a first vertical wall section 34 extending from the top deck 3. A horizontal flange 35 extends inwardly from the base 36 of the vertical wall section 34. The bottom section 41 of side 8 has a second vertical wall section 37 depends from the inner edge 38 of the flange 35 and connects to the edge 39 of bottom plate 4. As can be seen in FIG. 4, the top section 40 of second side 8 of one panel overlays the bottom section 43 of side 7 of the adjacent panel. The joint 44 between adjacent panels is sealed preferably with a urethane sealant to prevent moisture from getting between the panels and possibly corroding the support structure. The drainage channel 28 will collect and direct to the edge of the platform any moisture that does manage to penetrate the sealant or if the sealant is damaged by weather or environmental conditions. As shown in FIG. 5 one or more drip holes 45 can be provided in the bottom plate 4 to eliminate any moisture or condensation from within the base section 2.

The panel 1 can be attached to support columns, generally indicated at 46, provided to support the platform. The support columns 46 typically comprise a concrete footing 47 on which a metal I-beam 48 is mounted. The I-beams 48 are usually arranged to support adjacent panels along the length of the platform. To facilitate connection to the I-beam 48, panel 1 is provided with Z clip mounting brackets 49. A metal channel 57 is bonded to the inside 58 of bottom plate 4. Additional support haunches can be provided in the bottom plate if required. The Z clip bracket 49 is connected to channel 57 by machine screws 59 that go into threaded holes 60 in the channel 57. The Z clips 49, channel 57 and screws 59 are preferably stainless steel to resist corrosion. Testing of the panel indicated that the connection clips can withstand a 6000 lb uplift force with minimal 0.01 and 0.03 inches permanent deformation of the clip connection. This is more than adequate to withstand the uplift forces generated by high speed trains.

The base section 2 including the internal longitudinal and cross support members 9, 10 are formed of a polymer matrix composite comprising reinforcing fibers and a polymer resin to provide light weight and durability. Suitable reinforcing fibers include glass fibers, including but not limited to E-glass and S-glass, as well as carbon, metal, high modulus organic fibers (e.g., aromatic polyamides, polybenzamidazoles, and aromatic polyimides), and other organic fibers (e.g., polyethylene and nylon). Blends and hybrids of the various fibers can be used. Other suitable composite materials could be utilized including whiskers and fibers such as boron, aluminum silicate and basalt.

The resin material in the base section 2 is preferably a thermosetting resin, and more preferably a vinyl ester resin. The term "thermosetting" as used herein refers to resins which irreversibly solidify or "set" when completely cured. Useful thermosetting resins include unsaturated polyester resins, phenolic resins, vinyl ester resins, polyurethanes, and the like, and mixtures and blends thereof. The thermosetting resins useful in the present invention may be used alone or mixed with other thermosetting or thermoplastic resins. Exemplary other thermosetting resins include epoxies. Exemplary thermoplastic resins include polyvinylacetate, styrene-butadiene copolymers, polymethylmethacrylate, polystyrene, cellulose acetatebutyrate, saturated polyesters, urethane-extended saturated polyesters, methacrylate copolymers and the like.

Polymer matrix composites can, through the selective mixing and orientation of fibers, resins and material forms, be tailored to provide mechanical properties as needed. These polymer matrix composite materials possess high specific strength, high specific stiffness and excellent corrosion resistance. Polymer matrix composite materials, such as a fiber reinforced polymer formed of E-glass and a vinylester resin have exceptionally high strength, good electrical resistivity, weather and corrosion-resistance, low thermal conductivity, and low flammability.

The panels of FIGS. 1 to 8 can be fabricated by hand lay-up or other suitable methods including resin transfer molding (RTM), vacuum curing and filament winding, automated layup methods and other methods known to one of skill in the art of composite fabrication and are therefore not described in detail herein. Pultrusion fabrication is not an option where the top deck of the panel is formed with a taper from its midpoint as shown in the Figures.

A preferred method of making the panels of the present invention involves the use of vacuum assisted resin transfer injection. The process in general involves first laying down a plurality of glass sheets in a mould. The mould is typically a maximum of 4 to 5 feet wide and up to 15 to 20 feet long. Glass wrapped blocks of foam are then placed on top of the glass sheets. The space between the wrapped foam blocks forms the internal longitudinal and horizontal support members and the space to the edge of the mould forms the side and end walls of the panel. The top surface of the foam blocks are shaped to provide the taper over the length of the panels. If required tubes can be inserted into the mould to form raceways for electrical, plumbing or heating elements that may be desired to run along the platform. In addition if there are obstructions such as lamp posts on the platform, these can accommodated in the moulding process by framing around the space for the obstruction. Glass sheets are then placed on top of the foam blocks and the lid of the mould closed. A vacuum is applied to the mould to assist as the resin is injected into the mould. After the panel is removed from the mould, the area provided for any obstructions can be cut out in the panel and the foam is not exposed The result is a one piece panel fully completed in about one hour. This is substantial less time than to form the panel using pultrusions that are individually fastened together with bolts, screws or adhesives.

The panels of the present invention solve the problem of durability and premature breakdown of concrete and wood platforms due to degradation by environmental chemicals such as, salt, urea, acid rain, oil, greases as well as stray electrical currents. The light weight of the panels facilitates ease of installation in areas which have difficult access and work windows. The panels of the present invention also solve the problem of dealing with heavy concrete platforms (ten times heavier than the present invention) which necessitate the use of costly foundations and steel support systems. These benefits apply to both new and retrofit construction requirements. The panels of the present invention also solve a problem caused by joint expansion and degradation of seal integrity between panels with the provision of positive drainage channels. The drainage channels eliminate corrosive elements penetrating the joint past poorly installed or worn sealant joints which leads to the deterioration of the steel and or concrete structure and foundation. Reduced maintenance and long life cycles are achieved.

Typically the panels of the present invention sit on the grade and don't require the delay required for concrete to cure before they are ready to use. In addition, because the panels are formed to accommodate the detectable tiles there is not need to grind the deck to accommodate them as in the case of poured in place concrete platforms. The light weight of the panels also enables them to be used on elevated platforms typically using existing structural supports. Assembly of a typical platform installation using the panels of the present invention is completed within a few days as opposed to a number of weeks using other methods.

Figure 9:
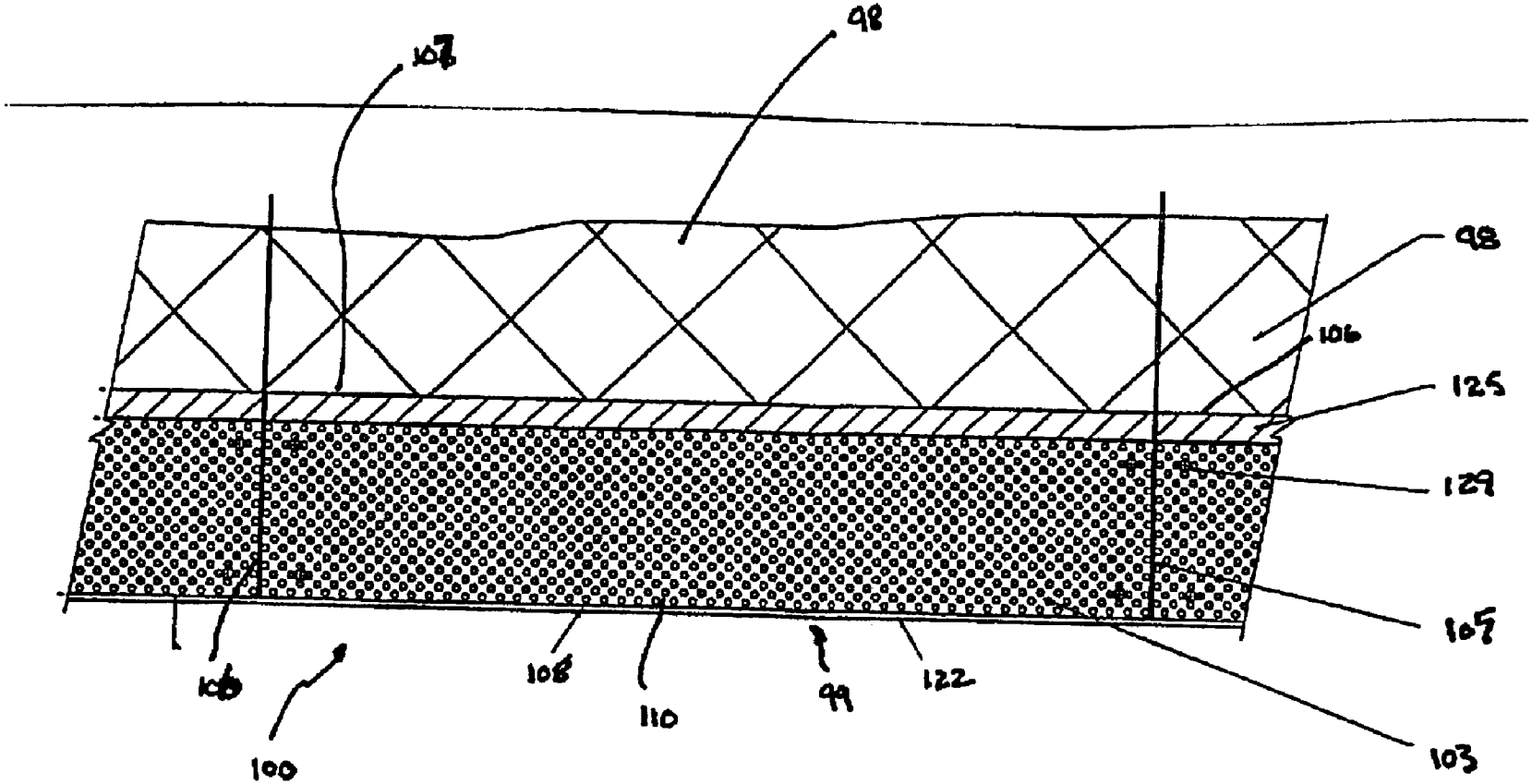
FIG. 9 is a top plan view of another embodiment of a transit boarding platform panel according to the present invention.
Figure 10:
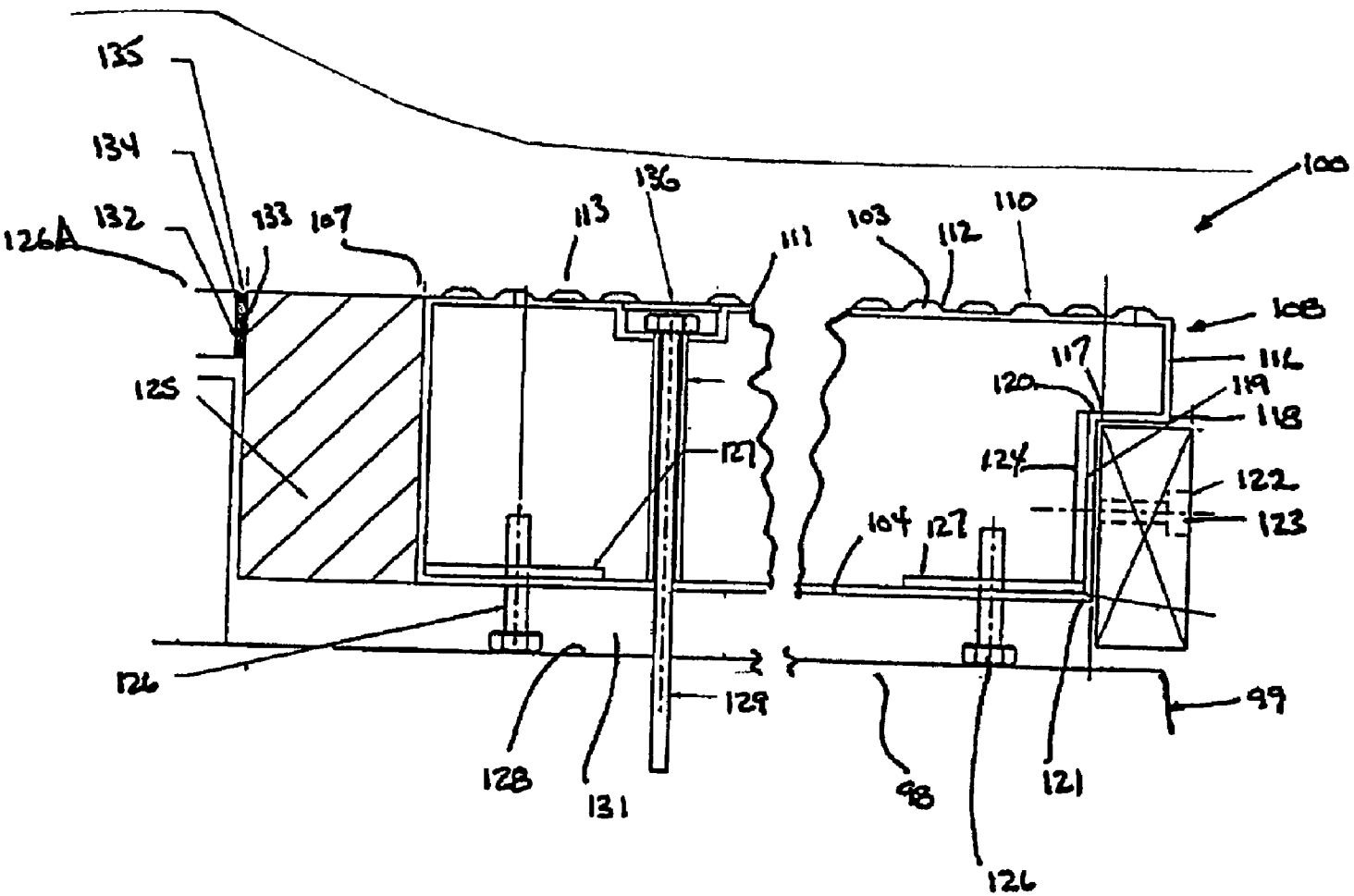
FIG. 10 is an enlarged schematic cross section of the transit boarding platform panel of FIG. 9 through line 10—10.
Figure 11:
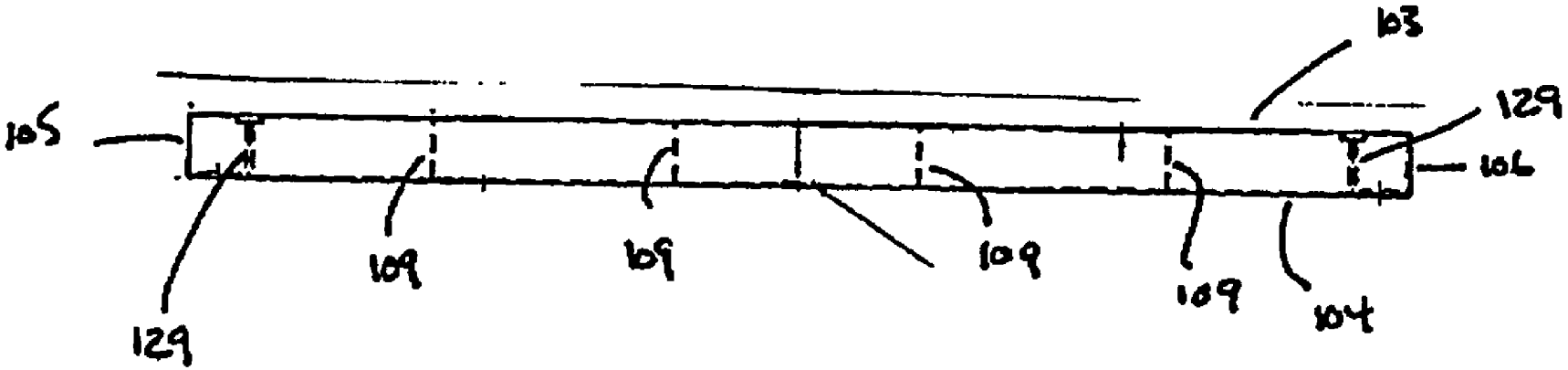
FIG. 11 is a schematic cross section of the transit boarding platform panel of FIG. 9 through line 11—11.

FIGS. 9 to 11, illustrate another embodiment of a panel for use with a transit platform according the present invention is generally indicated at 100. The panel 100 is suitable for use with the retrofit of an existing platform 98 as opposed to the replacement of the entire platform. The panel 100 is designed to fit along the edges 99 of the existing platform 98 adjacent the track (not shown). In the preferred embodiment illustrated the panel 100 is formed from a reinforced composite polymer comprising reinforcing fibers and a polymer resin to provide light weight and durability. The panel 100 has top deck 103 and bottom plate 104, a first end 105, a second end 106, a first side 107 and second side 108. Between the top deck 103 and bottom plate 104 are a series of internal cross support members 109.

The top deck 103 has detectable warning tiles 110 mounted to or formed integrally with the top surface 111 of the top deck 103.

The detectable warning tiles 111 are similar to the tiles described in previously. The surface 112 of the tiles 110 has plurality of rows of spaced buttons 113 projecting upwardly there from, thereby providing a distinctively textured surface relative to the texture of the surface of the platform. As can be seen in FIGS. 9 and 10, the buttons preferably are circular. Buttons in adjacent rows are offset from each other by one-half of the centerline spacing distance. The buttons 113 have generally flat upper surfaces which have texturing means thereon for creating a palpably rough surface texture. The texturing means in the preferred embodiment is provided by rows of semi-spherical raised dimples arranged in a grid pattern.

The areas between buttons preferably also have texturing means consisting of a plurality of rows of spaced dimples projecting upwardly there from, to provide slip resistance in those areas (e.g. for women in high heels and to improve maneuverability of wheelchairs).

To reduce the possibility of tripping, the height of the buttons in one or more rows adjacent the side 107 of panel 100 is reduced in height and diameter relative to the height and diameter of buttons in subsequent rows, so that there is a gradual increase in height and diameter. Thus in the preferred embodiment the buttons in the first row adjacent the side 107 of panel 100 are only about one-third as high as the other buttons and the buttons in the second row are only about two-thirds as high as the other buttons. Similarly the buttons in the first row have a diameter about 12% less than the other buttons and the buttons in the second row have a diameter about 3% less than the rest of the buttons.

The side 108 of the panel 100 adjacent the track, in the embodiment shown, is adapted to receive means to protect the panel 100 from damage. In the embodiment shown, side 108 of panel 100 has a first vertical wall section 116 extending from the top deck 103. A horizontal flange 117 extends inwardly from the base 118 of the vertical wall section 116. A second vertical wall section 119 depends from the inner edge 120 of the flange 117 and connects to the edge 121 of bottom plate 104. The means to protect the panel 100 comprises a plurality of bumpers 122 fastened to the second wall section 119. Bumpers 122 are of sufficient thickness that they extend past the base 118 of the first vertical wall section 116 and in the preferred embodiment is a single bumper the length of the panel and formed of polypropylene. The bumpers 122 are fastened to the panel 100 by means of bolts 123 that thread into plates 124 embedded in panel 100.

The side 107 of panel 107, in the embodiment shown, is adapted to provide a visual and sound contrast to the top deck 103 of panel 100 that is preferably made of yellow thermoset glass-reinforced plastic composite material. In the embodiment shown a black granite strip 125 is integrated with the panel 100 to provide a visual and cane-on-contact sound contrast to both panel 100 and the surrounding platform surface 126 A which is typically poured in place concrete or pavers.

As noted earlier panel 100 is typically utilized in a retrofit application to an existing platform. To install the panel 100, leveling bolts 126 are fastened to the bottom plate 104 by threading into reinforcing plates 127 formed into panel 100. The leveling bolts 126 are used to level the panel 100 on the surface 128 of the existing platform 98 on which the panel is being installed. Threaded rods 129 are inserted through tubes 130 in the panel 100 and screwed into the existing platform 98. To provide additional stability and support a grout bed 131 can be placed on the existing platform surface beneath the bottom plate 104. Alternatively two of the rods 129 can be inserted through holes in the granite strip 125 to fasten the second end 107 of panel 100 to the platform.

At the end 107 of the panel 100 remote from the edge 99 of the platform 98, the space between the panel 100 and the platform is filled with material to prevent moisture from penetrating the seam. In the embodiment shown a pre-molded joint filler 132 is inserted into the joint 133. A closed cell foam backer rod 134 is inserted next and then topped off with a self leveling urethane sealant 135.

A cap 136 is bonded with a structural adhesive over the rods 129.

It will be appreciated that a wide range of dimensions may be suitable for the panel 100. The panel 100 of the preferred embodiment shown in the drawings has nominal dimensions of 10 feet long by about 2 feet 4 inches in width. The panel has a nominal thickness of 6.5 inches and the panel plus leveling blots have a nominal height of 8 inches. The weight of the preferred embodiment is substantially less than the weight of standard precast concrete panels currently in use. Accordingly they can be used on elevated platforms typically using existing structural supports. Assembly of a typical platform installation using the panels of the present invention is completed within a few days as opposed to a number of weeks using other methods. The panels of the present invention were tested for vibration and load to test the ability of the panel to withstand the uplifting forces caused by passing rail traffic and the load bearing characteristics of the panel. Vibration tests on the preferred embodiment indicated vibration amplitudes below the human threshold of perception and comparable to results for precast concrete platforms.

Having illustrated and described a preferred embodiment of the invention and certain possible modifications thereto, it should be apparent to those of ordinary skill in the art that the invention permits of further modification in arrangement and detail. Variations in design are possible due to the flexibility and relative low cost of tooling used in the manufacturing process. Panel size, length, width, thickness, color, ribbing and surface profiles can be modified to suit specific project requirements. Drainage details can be modified to suit specific project requirements. Additional benefits of the present invention are the improved ability for the system to incorporate heat tracing systems for cold climates and electrical raceways for lighting and communication systems which can be integral to the panel. All such modifications are covered by the scope of the invention.

What is claimed is:

1. A transit boarding platform panel comprising a molded base portion formed from a reinforced composite polymer, said base portion having a top deck and bottom plate, first and second opposite ends wherein one or both of said first and second ends are adjacent an edge of the transit platform, a first side and second side, and between the top deck and bottom plate a series of internal support members, wherein said top deck, bottom plate, first and second opposite ends, first side, second side and series of internal support members are molded at the same time to form an integral unit, said top deck having a detectable warning surface consisting of raised truncated domes detectable by the visually impaired in accordance with Americans with Disabilities Act (ADA): Accessibility Guidelines for Buildings and Facilities at the ends of the panel adjacent the edge of the transit platform, wherein the first and second sides of said base portion are each provided with an interface for contacting an adjacent panel, the interface including a ship lap configuration for forming a drainage channel beneath joints formed between the adjacent panels.

2. A transit boarding platform panel according to claim 1 wherein the first side of said base portion is adapted to form a drainage channel along the joint between adjacent panels.

3. A transit boarding platform panel according to claim 2 wherein the first side of said base portion has a top section and a bottom section, said top section having a first vertical wall section having a first end adjacent said top deck and said first vertical wall section extending downwardly to a second end, a horizontal flange extending outwardly from the second end of the first vertical wall section and having an exterior edge, a second vertical wall section extends upwards from the exterior edge said horizontal flange, said second vertical wall section having a top edge and a bottom edge, a second horizontal flange having an inner and outer edge and extending outwardly from the top edge of the second vertical wall section.

4. A transit boarding platform panel according to claim 3 wherein the bottom section of said first side has third vertical wall section that depends from the outer edge of the second horizontal flange and connects to the bottom plate.

5. A transit boarding platform panel according to claim 4 wherein the second side of said base portion is adapted to overlie the drainage channel of an adjacent panel.

6. A transit boarding platform panel according to claim 5 wherein the second side of the base portion has a top section and a bottom section, said top section having a first vertical wall section extending downwardly from the top deck, a horizontal flange extends inwardly from the base of the vertical wall section, the bottom section of said second side has a second vertical wall section that depends from the inner edge of the horizontal flange and connects to the bottom plate.

7. A transit boarding platform panel according to claim 6 wherein the joint between the first and second sides of adjacent panels is adapted to be sealed to prevent moisture from getting between the panels.

8. A transit boarding platform panel according to claim 2 wherein the drainage channel is adapted to collect and direct to the edge of the platform any moisture that penetrates between panels.

* * * * *